US006327796B1

(12) United States Patent
Parisotto

(10) Patent No.: US 6,327,796 B1
(45) **Date of Patent: *Dec. 11, 2001**

(54) SKI BOOT

(75) Inventor: Davide Parisotto, Casella d'Asolo (IT)

(73) Assignee: Calzaturificio S.C.A.R.P.A. S.p.A., Asolo (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/490,690

(22) Filed: Jan. 24, 2000

(30) Foreign Application Priority Data

Jan. 26, 1999 (IT) ..... TO99A0054

(51) Int. Cl.[7] ..... A43B 5/04
(52) U.S. Cl. ..... 36/118.2; 36/54
(58) Field of Search ..... 36/117.4, 118.2, 36/119.1, 54

(56) References Cited

U.S. PATENT DOCUMENTS 3,972,134 * 8/1976 Kastinger .
4,601,118 * 7/1986 Zanatta .
4,677,769 * 7/1987 Ahmad et al. .
5,410,822 * 5/1995 Vaccari .
5,611,155 * 3/1997 Brown et al. .
5,651,199 * 7/1997 Chaigne et al. .
5,675,917 * 10/1997 Falguere et al. .

FOREIGN PATENT DOCUMENTS

353532 * 2/1990 (EP) .

* cited by examiner

*Primary Examiner*—Ted Kavanaugh
(74) *Attorney, Agent, or Firm*—Ladas & Parry

(57) ABSTRACT

Ski boot comprising a sole and a shell of plastic material designed to house the wearer's foot and including a flexible portion in correspondence with the metatarsus area, a leg piece hinged to the shell substantially at the ankle and designed to wrap the lower part of the leg of the wearer at the back and at the sides, a front closure tongue, fastening devices and releasable securing means between the tongue and the shell; the tongue comprises a lateral portion which extends on an internal lateral wall of the shell, and the lateral portion projects on the internal side of the shell beyond the profile of the flexible portion.

7 Claims, 2 Drawing Sheets

SKI BOOT

The present invention refers to a ski boot, in particular for telemark skiings

BACKGROUND OF THE INVENTION

This ski technique in which the heel is not rigidly held on the ski, but is free to rise, requires the use of special ski boots. This type of ski boot has a flexible area in correspondence with the metatarsus.

Ski boots of this type are composed of a sole, a shell in plastic material which is integral with the sole, where the foot of the wearer is housed, and a leg piece hinged to the shell substantially at the ankle and designed to wrap the lower portion of the wearer's leg at the back and at the sides.

A tongue for the frontal closure of the ski boot is fixed to the upper frontal area of the ski boot, and lies inside the front lateral portions of the leg piece.

The ski boot is provided with closure members on the upper part of the shell and between said front lateral portions of the leg piece.

Said flexible area generally consists of a corrugated portion located on the shell in the area of the metatarsus o f the wearer; said corrugated portion has one or more grooves which extend transversely to the shell and which begin and end in proximity with the sole, on opposite sides of the shell itself.

The flexing of the corrugated portion causes lateral swelling of the shell in correspondence with said portion, and exposes it to rubbing on the other ski, and consequently to excessive wear with respect to the other parts of the ski boot.

The consequence of this precocious wear of the internal part of the corrugated portion on the inside of the ski boot is the precocious replacement of the entire ski boot, even though this may be in excellent condition in all other parts.

SUMMARY OF THE INVENTION

The aim of the present invention is to provide a ski boot which resolves the problem of precocious wear of the internal part of the corrugated area, without prejudicing the flexibility or the technical characteristics.

According to the invention a ski boot is therefore made comprising a sole, a shell of plastic material designed to house the foot of the wearer and comprising a flexible portion in the metatarsus area, a leg piece hinged to the shell substantially at the ankle and designed to wrap the lower portion of the leg of the wearer at the back and at the sides, a front closure tongue and fastening devices, characterised by including releasable securing means between said tongue and said shell, and in that said tongue includes a lateral portion which extends on an internal lateral wall of said shell, said portion projecting on the internal side of said shell beyond the profile of the flexible portion.

In this manner a ski boot of the type used for the "telemark" technique is obtained which resolves the problem described above as afflicting ski boots of the known type. In fact the rubbing, and therefore the wear, of the boot on the ski worn on the other foot, does not occur on the shell, in correspondence with the flexible portion at the metatarsus, but on the portion of the tongue which extends along the lateral internal wall of the shell, and once this portion is worn or damaged just the front closure tongue can be replaced, rather than the entire ski boot.

BRIEF DESCRIPTION OF THE DRAWINGS

Further characteristics and advantages of the present invention will become clear from the following description of an embodiment, which is not limiting, with reference to the figures in the enclosed drawings, in which.

DETAILED DESCRIPTION OF THE INVENTION

Figure 1:
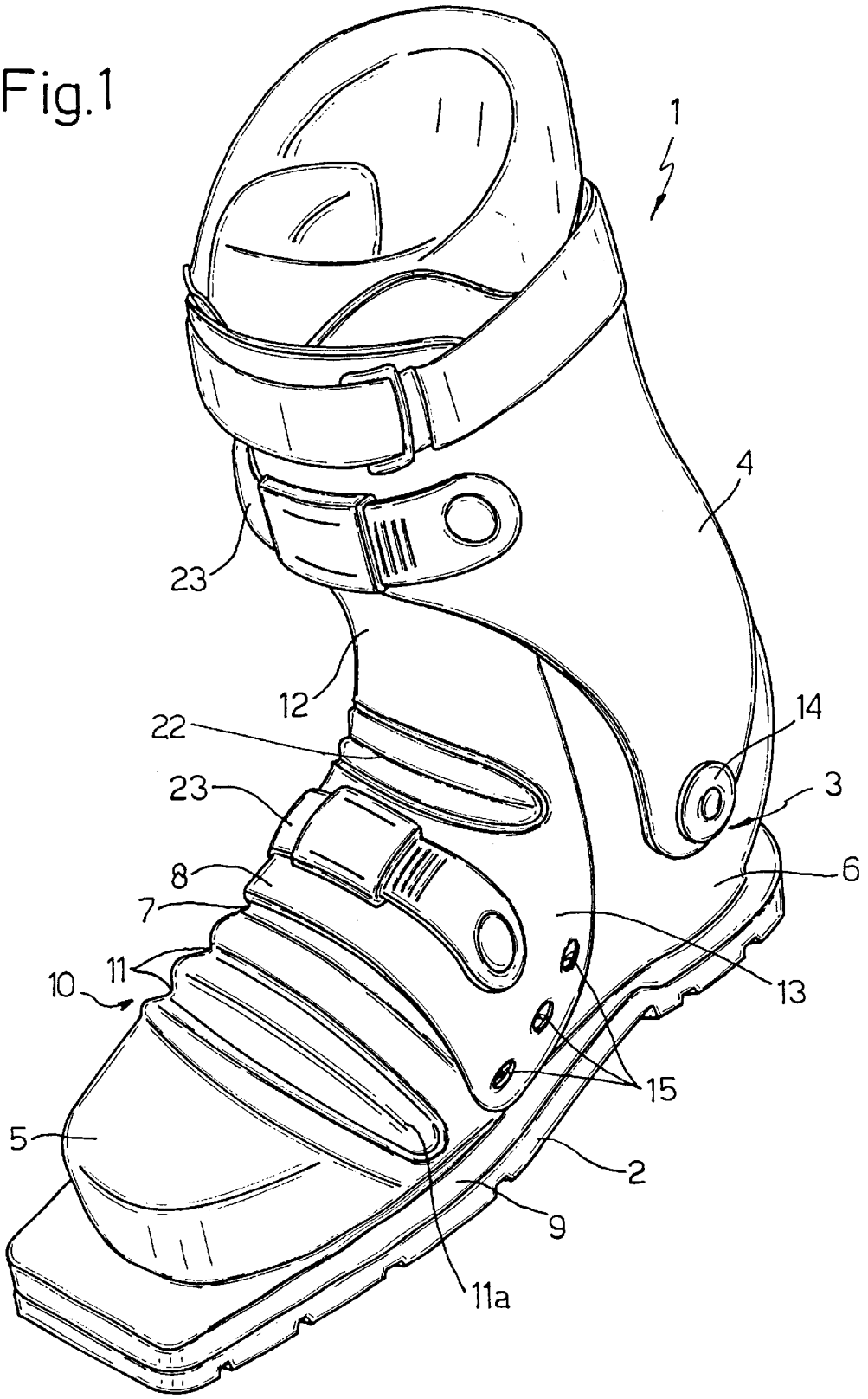
FIG. 1 is an overall perspective view of the ski boot according to the invention.

With reference to FIG. 1, number 1 indicates the ski boot as a whole, which essentially comprises a sole 2, a shell 3 of plastic material, designed to house the foot of the wearer, a leg piece 4, which is hinged to the shell substantially at the ankle and is designed to wrap the lower part of the wearer's leg at the back and at the sides.

Shell 3 integrally comprises a toe portion 5, a pair of lateral walls 6, 7, respectively internal and external forming together a frontal aperture (not shown) closed by a tongue 8, and a bottom wall or inner sole 9 which closes the bottom of shell itself. Sole 2 is of elastomeric material and is fixed to inner sole 9.

Shell 3 also has a flexible corrugated portion 10 which extends transversely with respect to the shell itself, from one side to the other of the sole 2, substantially in the metatarsus area. Said portion 10 has an undulated profile defined by a pair of grooves 11 separated by an intermediate rib 11*a* having a rounded profile.

Tongue 8 has a main portion 12 which extends along the upper frontal area of shell 3, and a lateral portion 13 lying over the internal lateral wall 6 of the shell 3 and fixed to it.

Leg piece 4 is fixed to the respective lateral walls 6, 7 of shell 3 by respective hinges 14 positioned in correspondence with transversal ankle to articulation axis.

Lateral portion 13 of the tongue 8 covers the internal lateral wall 6 of shell 3 down to the vicinity of inner sole 9.

Figure 2:
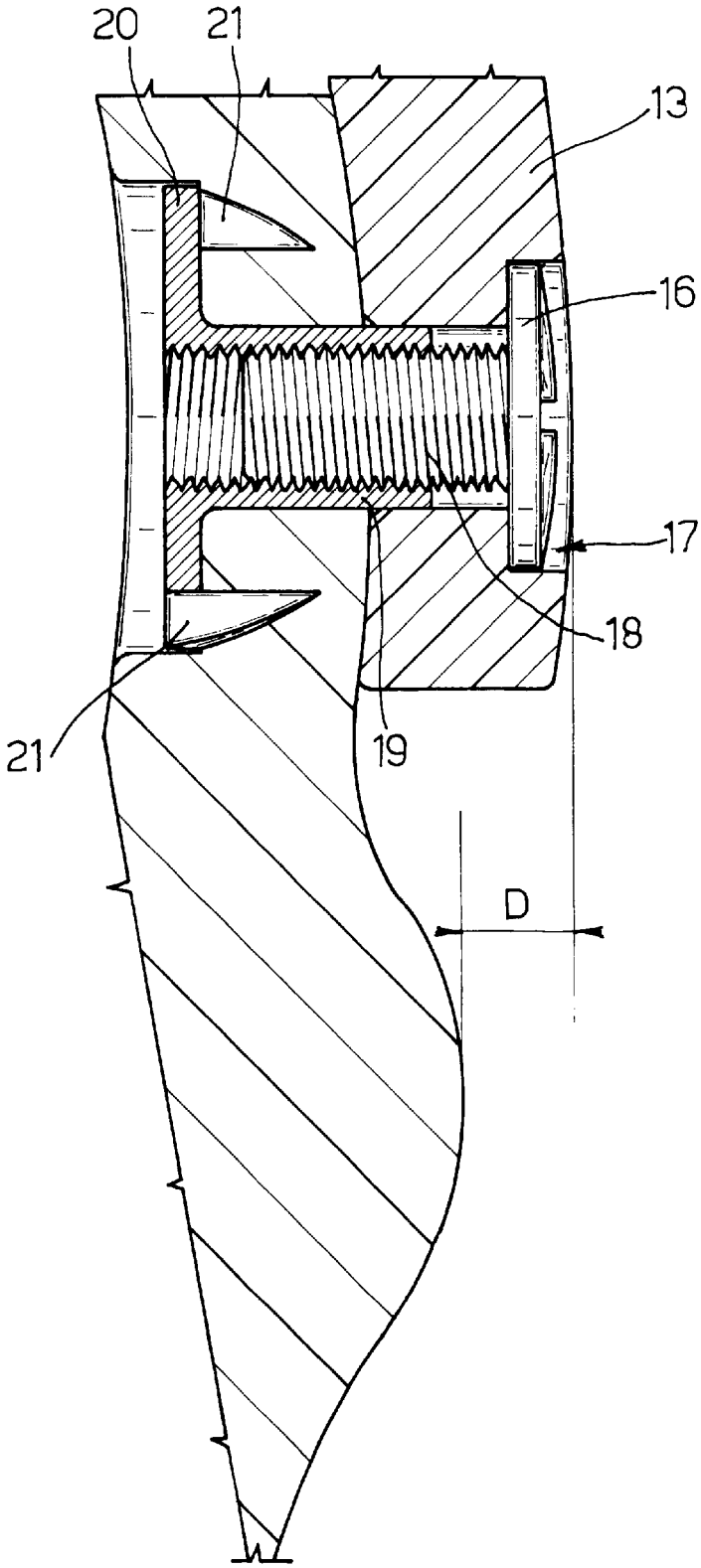
FIG. 2 is a cross section of a detail of the ski boot in FIG. 1.

Lateral portion 13 of the tongue 8 projects on the internal side of the ski boot beyond the profile of the corrugated portion 10 (FIG. 2) by a quantity 'D' determined in order to consider the swelling of corrugated portion 10 during flexion of the same.

Lateral portion 13 of tongue 8 is fixed on the internal lateral wall 6 of shell 3 by means of a number of screws 15, for example three.

Screws 15 each have a head 16 sunk into a suitable seat 17 in the lateral portion 13 of tongue 8, and a stem 18 screwed into a threaded bushing 19 fixed to the shell. Said threaded bushing 19 is housed in a respective passing hole in the internal wall 6, and is anchored to the wall itself by means of an internal support flange 20 provided with a number of teeth 21 driven into wall 6.

Ski boot 1 includes a second flexible area 22 in the main portion 12 of tongue 8 in correspondence with the area of articulation between the wearer's leg and foot. Ski boot 1 also includes a pair of fastening devices 23 with buckles and toothed belts, interposed respectively between the flaps of leg piece 4 and between portion 13 of tongue 8 and the lateral external wall of shell 3.

On the ski boot according to the invention the possible rubbing between the ski boot and the ski worn on the other foot affects the lateral portion 13 of the tongue 8 and not the shell proper in the corrugated area. The wear on said portion 13 does not require the replacement of the entire ski boot, but exclusively of tongue 8. Removal of tongue 8 is particularly simple, involving only the unscrewing of the screws 15.

Finally, it is clear that alterations and variations may be made to the ski boot 1 described above without departing from the scope defined by the claims.

In particular, the flexible portion may be made of a different material than the remaining part of the shell, and it may not have corrugations if the flexibility of the material does not require them.

Screws 15 may be replaced by any other means of releasable securing means, for example a coupling or joint.

What is claimed is:

1. A ski boot (1) comprising a sole (2); a shell (3) formed from plastics material and designed to house a wearer's foot, said shell (3) being of unitary construction and comprising a toe portion (5), an internal lateral wall (7), an external lateral wall (6) and a flexible portion in the metatarsus area (11, 11*a*); a front closure tongue (8); and a leg piece (4) hinged to the shell (3) substantially at the ankle and designed to wrap the lower part of the wearer's leg; and means (15) for releasably securing said tongue (8) to said shell (3), said means (15) being disposed on said tongue (8) and spaced from said metatarsus area (11, 11*a*) and from said leg piece (4), said tongue (8) including a lateral portion overlapping said internal lateral wall of said shell (3) and projecting on the internal side of said shell (3) beyond the lateral profile of said flexible portion (11, 11*a*).

2. Ski boot as claimed in claim 1, wherein in the flexible portion (10) is corrugated.

3. Ski boot as claimed in claim 1, wherein said tongue (8) covers the internal lateral wall (6) of said shell (3) down to the vicinity of the sole (2).

4. Ski boot as claimed in claim 1, wherein said means for releasably securing connect said lateral portion (13) of said tongue (8) to said internal lateral wall (6) of said shell (3).

5. Ski boot as claimed in claim 1, wherein said means for releasably securing means include at least one screw.

6. Ski boot as claimed in claim 5, wherein said screw is screwed into a threaded bushing (19) fixed in said shell (3).

7. Ski boot as claimed in claim 6, wherein a head (16) of said screw (15) is sunk into a suitable seat (17) obtained in said lateral portion (13) of said tongue (8).

* * * * *